United States Patent [19]

Kramer

[11] Patent Number: 4,497,593

[45] Date of Patent: Feb. 5, 1985

[54] FLOATING STRUCTURES

[75] Inventor: James H. Kramer, Akron, Ohio

[73] Assignee: The B. F. Goodrich Company, New York, N.Y.

[21] Appl. No.: 434,029

[22] Filed: Oct. 13, 1982

[51] Int. Cl.[3] ..... B63B 59/02; E02B 3/22; F16F 1/14

[52] U.S. Cl. ..... 405/212; 405/215; 114/219; 267/140; 267/57.1 R

[58] Field of Search ..... 405/211-215, 405/216; 114/219, 220; 14/76; 267/57.1 R, 57.1 A, 139, 140, 140.1, 154

[56] References Cited

U.S. PATENT DOCUMENTS

| | | | |
|---|---|---|---|
| 1,117,579 | 11/1914 | Kause | 405/212 X |
| 2,417,849 | 3/1947 | Walters et al. | 114/220 |
| 2,420,677 | 5/1947 | Peterson | 405/212 |
| 2,596,904 | 5/1952 | Krotz | 267/57.1 R |
| 2,677,936 | 5/1954 | Hewitt | 405/212 |
| 2,842,939 | 7/1958 | D'Auriac | 114/219 X |
| 3,173,270 | 3/1965 | Blancato | 405/212 |
| 3,399,907 | 9/1968 | Hein | 405/215 X |
| 3,795,392 | 3/1974 | Nemee | 267/140 |
| 3,852,968 | 12/1974 | Holley | 405/212 |
| 3,853,084 | 12/1974 | Kedar | 405/215 X |

FOREIGN PATENT DOCUMENTS

| | | | |
|---|---|---|---|
| 712320 | 1/1980 | U.S.S.R. | 405/212 |

*Primary Examiner*—Cornelius J. Husar
*Assistant Examiner*—Nancy J. Stodola
*Attorney, Agent, or Firm*—Joseph Januszkiewicz

[57] ABSTRACT

A fender system for a floating structure such as an offshore platform wherein a column supporting the platform has a plurality of vertically spaced rail members that are interconnected by a plurality of horizontally spaced and vertically extending bumpers that can be contacted by a vessel for transmitting the force therefrom to the fender system. The rail members support a plurality of spaced shafts on which are mounted pairs of interconnected torsion spring members that are operative to exert opposing forces while bearing on the column to absorb the forces exerted on the fender system.

8 Claims, 6 Drawing Figures

FLOATING STRUCTURES

BACKGROUND OF THE INVENTION

This invention relates to a floating structure and more particularly to a fender protective system on a floating structure such as an off-shore platform.

In the exploration and development of off-shore oil and gas wells it is necessary to provide materials and supplies for drilling operations on an off-shore platform. Such platform with their vertical supports are large and subject to movement in response to the action of the waves. As barges, work boats, or vessels dock at such platforms and their supports, considerable care must be exercised to prevent damage to such vessels as well as to the floating platform due to the substantial amount of heaving and roll motion encountered by a vessel in response to the ocean waves. Such motion seriously impedes the docking of such vessels and their corresponding transfer of materials and supplies. In order to reduce the difficulty of docking such vessels for loading, a fender system has been designed to accommodate large vessels and permit such vessel a great degree of movement and maneuvering relative to the platform to substantially reduce the danger of damage. The present invention utilizes a unique energy absorbing system that protects the platform or rig and its auxiliary parts and vessel from damage. The present invention provides a plurality of torsion springs all interconnected to distribute the reactive forces imparted thereon. When depending legs of a platform are damaged considerable effort must be expanded to effect repairs, including the pumping out of the ballast from the tubular legs prior to repairs. Considerable time is lost in the following down time, including the down time for inspections by the numerous administrative officials. Accordingly, it is imperative to provide a fully operative fender system that minimizes damage under adverse operating conditions and thereby minimizing down time.

SUMMARY OF THE INVENTION

The present invention contemplates a fender protective system for an off-shore platform employing a plurality of torsion springs interconnected to provide a plurality of pads contacting a column to be protected. The pads are operative to slide arcuately on the column as a force is exerted on the overall forwardly disposed contact members. The torsion springs are connected in pairs, such that each pair of springs have a common axis or pivot so that any force thereon acts to rotate the respective springs in opposition to each other to absorb the reactive forces. The respective springs are all interconnected to distribute the load or forces.

DETAILED DESCRIPTION

Figure 1:
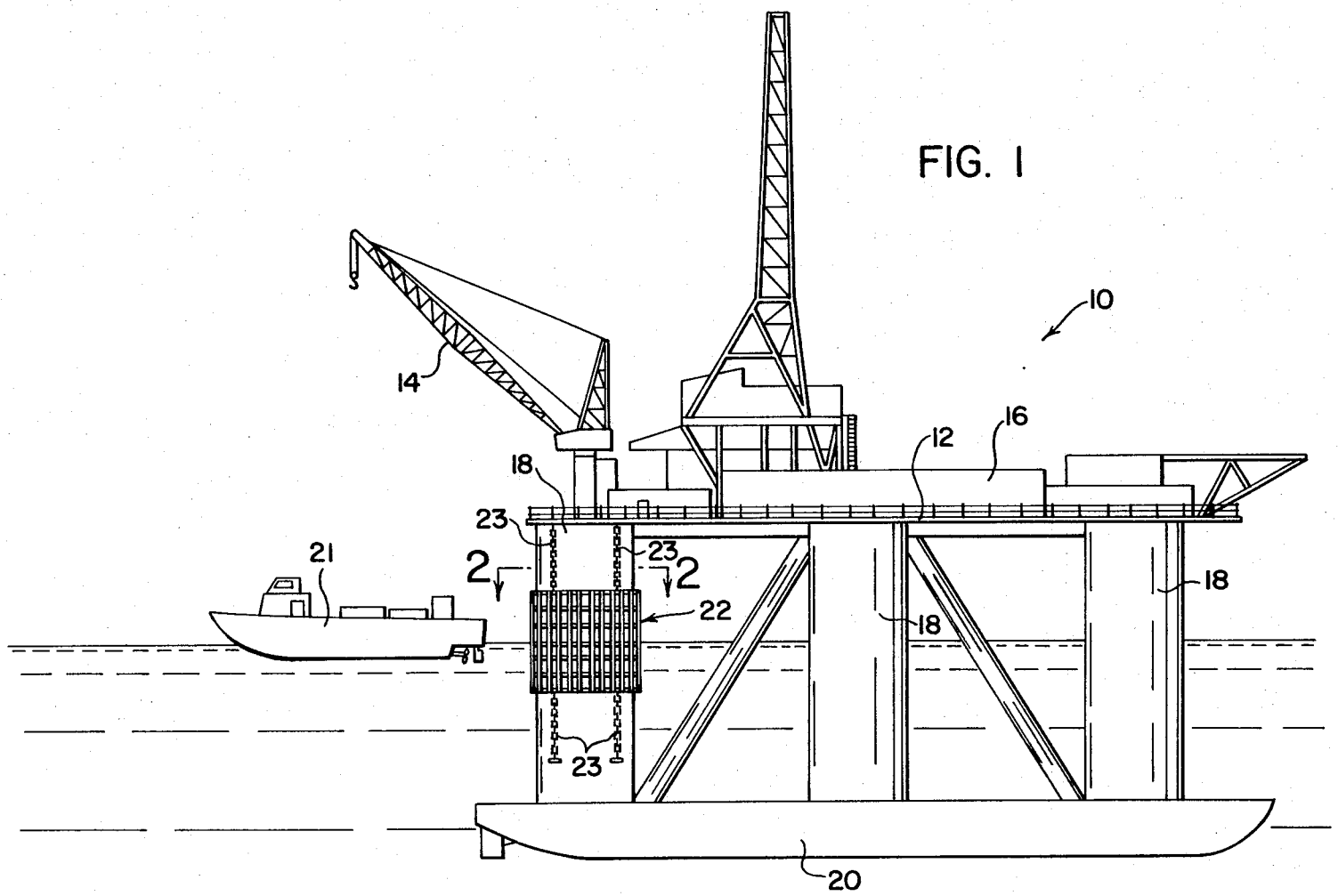
FIG. 1 is a side elevational view of a floating platform structure showing the fender protection system on one of the supporting legs.

Referring to the drawings wherein like reference numerals designate like or corresponding parts throughout the several views, there is shown in FIG. 1 a floating structure 10 which includes a deck 12 having an unloading crane 14 mounted thereon along with quarters 16 and other equipment. The deck 12 is supported by a plurality of support columns 18, which in turn are connected to a plurality of buoyant, ballastable support structures or pontoons 20 (only one shown). The pontoons 20 can be suitably connected to other depending structure which are suitably anchored. FIG. 1 also discloses a vessel 21 adjacent to one support column 18. A fender system 22, to be described, is attached by chains 23 to the support columns 18 to be protected.

Figure 2:
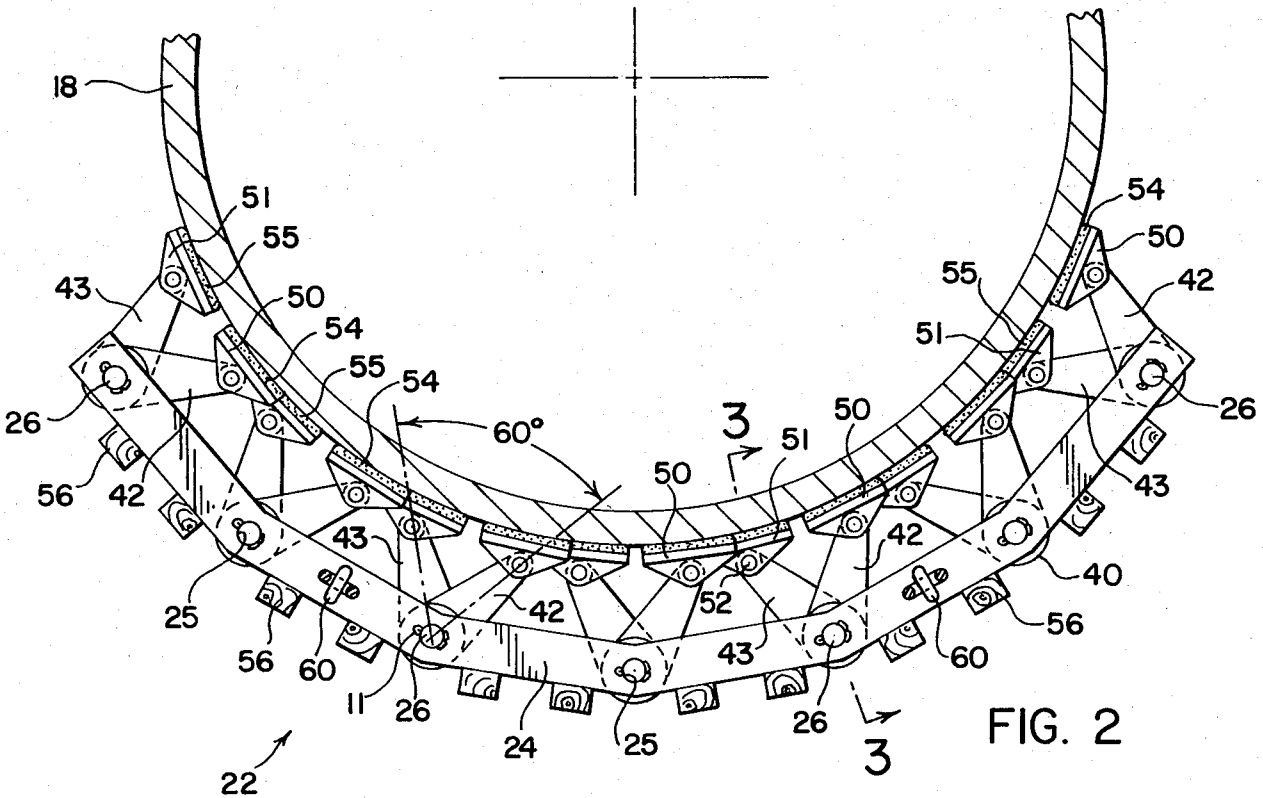
FIG. 2 is a plan view of the fender protection system taken on line 2—2 of FIG. 1.
Figure 3:
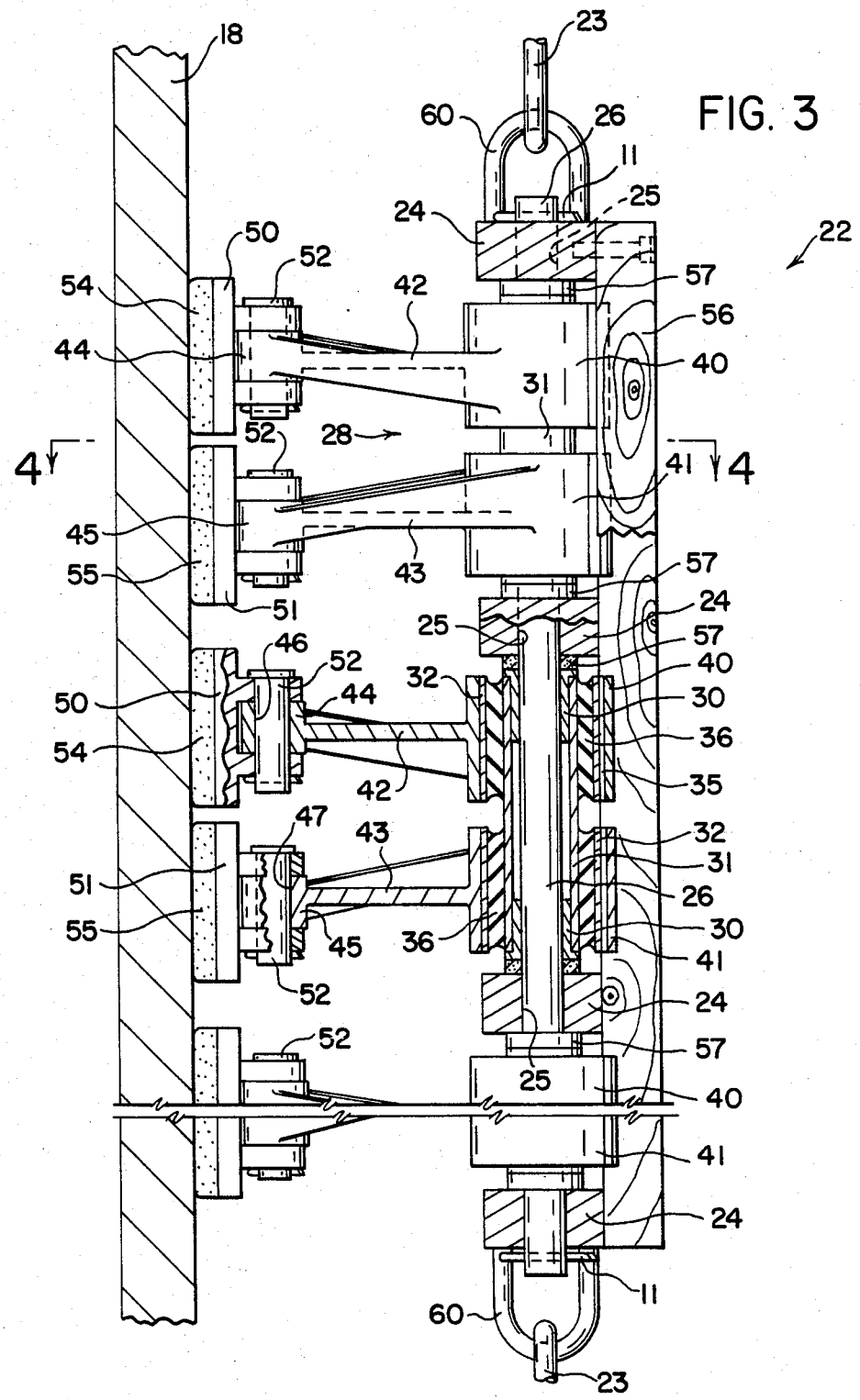
FIG. 3 is a side elevational cross-sectional view of a portion of the bumper system taken on line 3—3 of FIG. 2.
Figure 4:
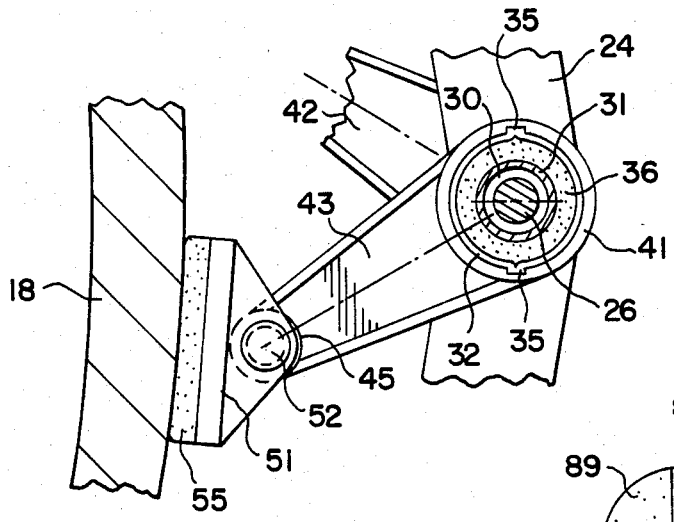
FIG. 4 is a plan view of a portion of the bumper system taken on line 4—4 of FIG. 3.

Fender system 22 has a plurality of vertically spaced horizontally extending rail members or support members 24, which rail members 24 can be arcuate in shape or a series of linear portions formed into a general arcuate path. Rail member 24 is a semgment, which as shown is FIG. 2, covers approximately 120° of the complete circumference of support column 18. Each support member or rail member 24 has a plurality of horizontally spaced bores 25, which bores 25 are vertically aligned on the respective vertically spaced rail 24 to receive tubular members or shafts 26. Shaft 26 is retained on rail members 24 by suitable clips 11. Mounted on each shaft 26 between the respective vertically spaced rail members or support members 24 are torsilastic spring means 28. Each spring means 28 includes a pair of vertically spaced bushings 30 received by shaft 26. The respective outer circumferential surfaces of the vertically spaced bushings 30 receive the respective ends of the cylinder or the hollow cylindrical shaft 31. The cylindrical shaft 31 is concentric with a pair of vertically spaced sleeves or cylinders 32. A pair of diametrically opposed keys 35 (FIG. 4) are formed on the outer periphery of each sleeve 32. An elastomeric sleeve or ring as of rubber 36, which is the spring element of the torsion spring means 28, is molded and vulcanized in the space between the shaft 31 and the pair of vertically spaced sleeves 32 with a suitable rubber-to-metal adhesive. The molding and vulcanizing operation firmly bonds the sleeves 32 to the cylindrical shaft 31. As seen in FIG. 3, the vertically spaced sleeves 32 and the cylindrical shafts 31 with the rubber spring element 36 forms an upper torsion member and a lower torsion member which are connected to vertically spaced hubs 40 and 41 respectively via the keys 35 formed on the outer periphery of each sleeve 32. Hubs 40 and 41 have outwardly extending arms 42 and 43 respectively. Arms 42 and 43 subtend an angle of approximately 60 degrees between them as measured between vertical planes passing through the apex of a shaft 26 and through the center lines of arms 42 and 43. The outer ends of arms 42 and 43 terminate into a hub 44 and 45 respectively with bores 46 and 47 extending therethrough. Pivotally connected to the hubs 44 and 45 are bifurcated support members 50 and 51 respectively joined thereto by flanged pivot pins 52. The outer face of each support member 50 and 51 has a bearing pad 54 and 55 suitably connected thereto.

A plurality of vertically extending supports or wooden timbers 56, spaced laterally along the forward surfaces of rail members 24, are suitably secured to certain ones of the rail members 24 to thereby provide a replaceable bumper member. Annular spacers 57 are positioned on shaft 26 between bushings 30 and rail members 24. The uppermost and lowermost rail members 24 have U-shaped clamps 60 secured thereto. The columns 18 have a plurality of clamps suitably spaced along the upper end adjacent to the deck 12 and also along the lower end. Chains 23 interconnect the clamps on column 18 with the clamps 60 on the fender system to thereby retain such fender system at a given location on the column 18 to protect such column from damage as vessels negotiate nearby to take on or leave off cargo.

In the operation of the described apparatus, as a vessel 21 approaches and strikes the wooden timbers 56, the force is transmitted to the rail members 24, which in turn transmit the forces to the plurality of arms 42, 43 and the support members 50 and 51 that are adjacent thereto. The effect of the force will affect several of the torsion spring members, since the wooden timbers 56 distribute the load over a broad area with its connection to the several rail members 24 which in turn transmits the force to the several shafts 26. The pairs of support members 50 and 51 which are mounted on common shafts 26 tend to pivot away from each other, such that the pads 54 and 55 will move or slide arcuately along the outer surface of the columns 18. The action of the pairs of support members 50 and 51 and their respective arms 42 and 43 operate to exert opposite rotative forces on their rubber sleeves 36 whose inner surface is bonded to their common shaft 31. Thus the respective arms 42 and 43 operate to dissipate the force within the torsion spring means 28. The degree of arcuate movement of the pairs of pads 54 and 55 is dependent on the force exerted by the vessel 21 on the fender system 22. To provide a greater degree of linear movement of the vessel relative to column 18, arms 42 and 43 may be lengthened such that there is greater movement of such arms. By loading the respective pairs of arms to a pair of torsion springs on common shafts 31 the symmetrical action of the pads 54, 55 and their arms 42, 43 provide an efficient means for resiliently resisting the impact of a vessel docking at the columns 18.

Figure 5:
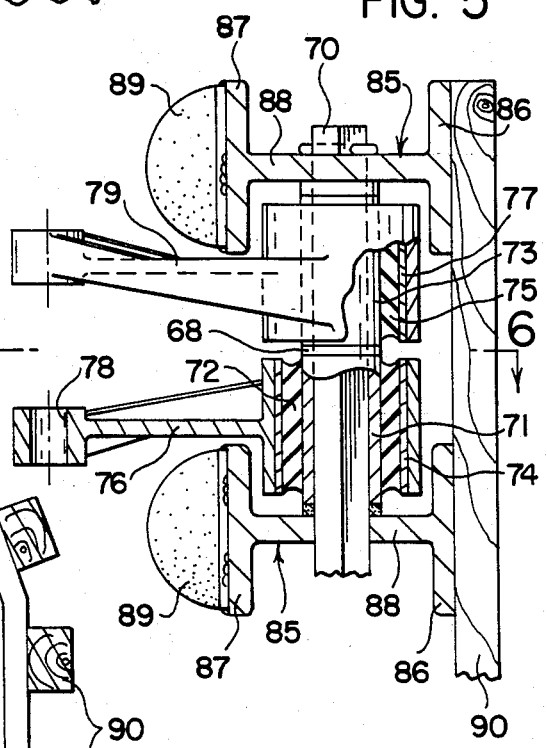
FIG. 5 is side elevational view of a portion of a modified form of the invention.
Figure 6:
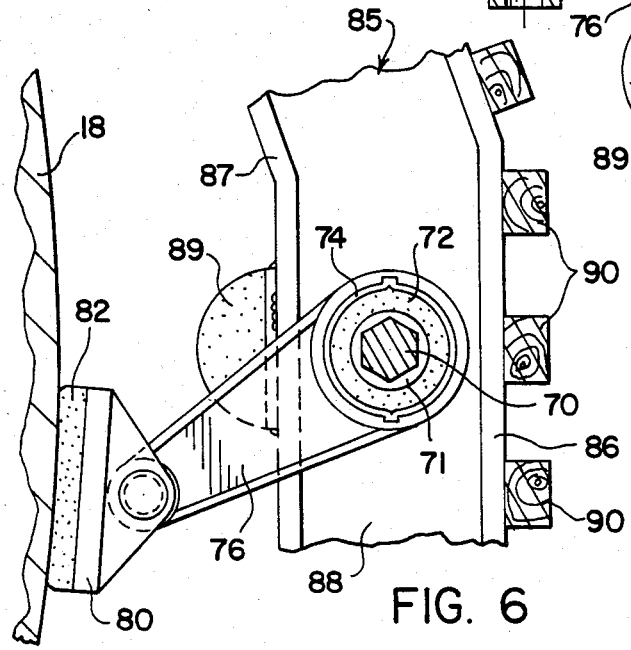
FIG. 6 is a plan view of a portion of the modified form of the invention taken on line 6—6 of FIG. 5.

A modified form of the invention is shown in FIGS. 5 and 6 wherein a polygonal cross-sectional shaft 70 is used in lieu of the round shafts 26 and the bushing 30. As seen in FIG. 5 a shaft 70 bears directly against an inner torsion member or hollow shaft 71 whose central bore is polygonal in cross-section. The outer surface of torsion member 71 is secured as by adhesives to a rubber sleeve 72. The outer surface of rubber sleeves 72 is adhered to an annular cylinder or sleeve 74. The sleeve 74 has an external key for connecting it to the hub of elongated arm 76. The outer hub of the arm 76 has a bore 78 for connection to a bifurcated support member 80 (similar to members 50 and 51 of the first embodiment). Support member 80 has a bearing pad 82 which bears on column 18 and is operative to slide on such column as described in the first embodiment. It should be noted that the first embodiment utilized a single hollow cylinder or shaft 31 connected via two separate annular rubber rings 36 to vertically spaced arms 42–43 and pads 54–55 whereas the second embodiment has separate hollow cylinders or shafts 71 connected to their respective arms via their separate rubber rings since the polygonal shaft 70 operates as the common shaft for the diverging arms to be described. To complement the action of each torsion member or hollow shaft 71, a second hollow shaft 73 with a central polygonal cross-sectional bore is slidingly received by shaft 70, directly above hollow shaft 71. A spacer 68 separates the two hollow shafts 71 and 73. The outer surface of hollow shaft 73 is secured as by adhesives to a rubber sleeve 75. The outer surface of rubber sleeve 75 in turn is adhered to an annular cylinder or sleeve 77. The sleeve 77 has an external key for connecting it to the hub of an elongated arm 79. The outer hub of arm 79 is connected to a bifurcated support member such as 80, which in turn is connected to a bearing pad which bears on column 18 in opposition to the bearing pad 82 of the lower torsion spring member. Thus the opposing pads action in opposition to each other operates to dissipate the reactive forces exerted on their common shaft 70. As in the first described embodiment, the torsion spring members act in pairs to provide a balanced torsion spring means to dissipate the forces acting thereon.

In lieu of the rail member 24, the second embodiment has an H-shaped in cross-section support member 85. As in the first embodiment the support member 85 extends horizontally in a generally arcuate path. Support member 85 has a pair of spaced flanged portions 86 and 87 interconnected by a web section 88. The vertically extending wooden timbers or bumpers 90 are suitably connected to the flanges 86 while resilient arcuate rubber bumpers 89 are mounted on the flanges 87. Rubber bumpers 89 are used to provide additional cushioning action between the fender system and the columns 18 as well as to limit the movement of the fender system towards the column 18 to prevent overtravel.

The operation of the modified form of the invention is identical to the first embodiment's operation described above.

It is apparent that, although certain embodiments of the invention have been described in detail, the invention is not limited to the specifically illustrated and described constructions since variations may be made without departing from the principles of the invention.

I claim:

1. A fender system for a floating structure wherein said structure has a deck and a plurality of depending support columns, said fender system having a plurality of vertically spaced horizontally extending rail members, said horizontal rail members are interconnected by a plurality of shafts extending therethrough, torsion spring means are mounted on each of said shafts, each of said spring means having a cylinder mounted on said shafts, a pair of vertically spaced sleeves mounted in concentric relationship on each of said cylinders, an annulus of elastomeric material located between each of said pair of sleeves and said cylinders that are concentrically spaced therefrom, each of said annulus of elastomeric material having an inner surface and an outer surface that are secured to said cylinders and said sleeves respectively providing a yieldable torsion member, an arm member keyed to each of said sleeves forming pairs of arm members, each pair of arm members are off-set relative to the center line of the shaft on which said pair of arm members are located, each of said arm members having a pad thereon for contacting one of said columns, said arm member diverging from said shaft in each pair of said sleeves, and said fender system being mounted on said columns for abutting contact of said pads with said columns.

2. A fender system for a floating structure as set forth in claim 1 wherein each of said rail members have a plurality of yieldable members mounted thereon to limit the movement of said fender system toward said columns.

3. A fender system for a floating structure as set forth in claim 1 wherein only one pair of said spring means is located between adjacent rail members.

4. A fender system for a floating structure as set forth in claim 3 wherein said rail members have a plurality of laterally spaced vertically extending bumper members mounted thereon for contact by vessels to protect said columns.

5. A fender system for use with an off-shore floating platform, said platform having a deck and a plurality of vertically disposed columns, said fender system having a plurality of vertically spaced horizontally extending rail members, said vertically disposed columns lying in an arcuate path in plan, a plurality of laterally spaced vertically extending shafts extending through said rail members, each of said shafts having at least a pair of outwardly diverging arm members between adjacent rail members that are off set relative to each other and the center line of said shaft on which said arm members are mounted, each of said pair of arm members having one end secured to separate sleeves that are vertically spaced from each other, the center line of said sleeves being concentric with the center line of said shaft on which said sleeves are mounted, each of said sleeves having an inner circumferentially extending surface, a hollow shaft coextensive with said sleeves and mounted concentrically within said sleeves, said hollow shaft having an exterior surface, a pair of axially spaced annular elastomeric rings bonded to said exterior surface, one of said rings bonded to said inner surface of one of said sleeves, the other one of said rings bonded to said inner surface of the other one of said sleeves, and the other end of each of said arm members having a bearing pad secured thereto for contacting said column.

6. A fender system as set forth in claim 5 wherein said hollow shaft comprises a pair of vertically spaced hollow shafts, and each one of said pair of vertically spaced hollow shafts having one of said vertically spaced sleeves coextensive therewith to provide a pair of opposed torsion springs secured to a common shaft which is one of said vertically extending shafts that extends through said rail members.

7. A fender system as set forth in claim 6 wherein said rail members have a forwardly disposed face and a rearwardly disposed face, and said forwardly disposed face has bumpers mounted thereon for interconnecting all of said rail members for contact with vessels.

8. A fender system as set forth in claim 7 wherein said rearwardly disposed face of said rail members have rubber bumpers thereon for limiting the movement of said rail members towards said columns.

* * * * *